US008434567B2

(12) United States Patent
Menezes et al.

(10) Patent No.: US 8,434,567 B2
(45) Date of Patent: May 7, 2013

(54) BOREHOLE DRILLING APPARATUS, SYSTEMS, AND METHODS

(75) Inventors: Clive D. Menezes, Houston, TX (US); Michael Dewayne Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 12/896,386

(22) Filed: Oct. 1, 2010

(65) Prior Publication Data

US 2011/0031023 A1 Feb. 10, 2011

Related U.S. Application Data

(63) Continuation of application No. PCT/US2009/040741, filed on Apr. 16, 2009.

(60) Provisional application No. 61/045,344, filed on Apr. 16, 2008.

(51) Int. Cl.
*E21B 7/06* (2006.01)
*E21B 17/10* (2006.01)
*E21B 47/022* (2012.01)

(52) U.S. Cl.
USPC ..... 175/61; 175/26; 175/45; 175/76; 175/325.3

(58) Field of Classification Search ..... 175/26, 175/40, 45, 61, 76, 325.3
See application file for complete search history.

(56) References Cited

U.S. PATENT DOCUMENTS

| | | | | |
|---|---|---|---|---|
| 5,318,137 | A * | 6/1994 | Johnson et al. | 175/40 |
| 5,318,138 | A * | 6/1994 | Dewey et al. | 175/74 |
| 5,332,048 | A * | 7/1994 | Underwood et al. | 175/26 |
| 5,603,386 | A * | 2/1997 | Webster | 175/76 |
| 5,931,239 | A * | 8/1999 | Schuh | 175/61 |
| 6,213,226 | B1 * | 4/2001 | Eppink et al. | 175/61 |
| 6,227,312 | B1 * | 5/2001 | Eppink et al. | 175/57 |
| 6,488,104 | B1 * | 12/2002 | Eppink et al. | 175/61 |
| 6,513,606 | B1 * | 2/2003 | Krueger | 175/61 |
| 6,626,254 | B1 * | 9/2003 | Krueger et al. | 175/61 |
| 7,891,441 | B2 * | 2/2011 | Lee | 175/267 |
| 2011/0031023 | A1 * | 2/2011 | Menezes et al. | 175/61 |

FOREIGN PATENT DOCUMENTS

WO WO-2009146190 A9 12/2009

* cited by examiner

*Primary Examiner* — Jennifer H Gay
(74) *Attorney, Agent, or Firm* — Schwegman Lundberg & Woessner, P.A.; Clive D. Menezes

(57) ABSTRACT

Apparatus, systems, and methods may operate to couple a tubular member to a bottom hole assembly, dispose at least one adjustable stabilizing member on the tubular member, and control at least one of a radial extension of the adjustable stabilizing member and an axial position of the adjustable stabilizing member relative to the bottom hole assembly to adjust a borehole trajectory, wherein the adjustable stabilizing member is adjustable in both radial and axial directions. Additional apparatus, systems, and methods are disclosed.

20 Claims, 6 Drawing Sheets

BOREHOLE DRILLING APPARATUS, SYSTEMS, AND METHODS

CLAIM OF PRIORITY

This application is a continuation under 35 U.S.C. 111(a) of International Application No. PCT/US2009/040741 filed Apr. 16, 2009 and published as WO 2009/146190 on Dec. 3, 2009, which claims benefit of priority, under 35 U.S.C. Section 119(e), to U.S. Provisional Patent Application Ser. No. 61/045,344, filed Apr. 16, 2008, the benefit of priority of each of which is claimed hereby, and each of which are incorporated by reference herein in its entirety.

BACKGROUND

Directional drilling bottom hole assemblies (BHA) are often required to build or drop inclination in the vertical plane and/or turn in the horizontal plane to reach a desired downhole target zones. A stabilizer may be attached to the BHA to control the bending of the BHA to direct the bit in the desired direction (inclination and azimuth). Radially adjustable stabilizers may be used in the BHA of directional drilling systems to provide an initial angle to the BHA with respect to the axis of the borehole to assist in turning the direction of the borehole. A radially adjustable stabilizer provides a wider range of directional adjustability than is available with commonly used fixed diameter stabilizers. This saves rig time by allowing the BHA to be adjusted downhole instead of tripping out for changes. However, even the use of radially adjustable stabilizers provides only a limited range of directional adjustments.

BRIEF DESCRIPTION OF THE DRAWINGS

A better understanding of various embodiments can be obtained when the following Detailed Description is considered in conjunction with the following drawings, in which.

DETAILED DESCRIPTION

Figure 1:
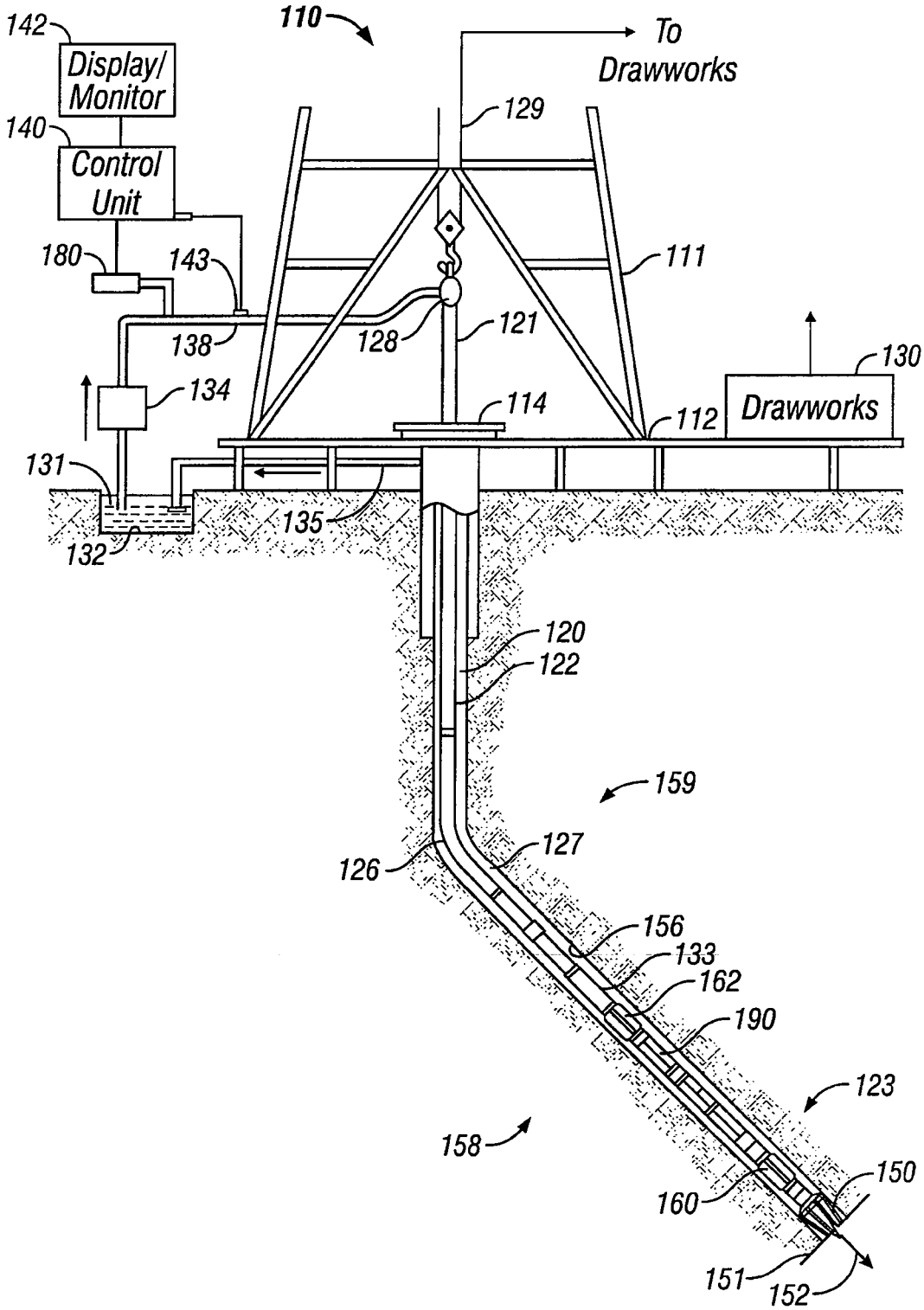
FIG. 1 shows a schematic example of a drilling system according to various embodiments of the invention.

FIG. 1 shows a schematic diagram of a drilling system 110 having a downhole assembly according to one embodiment of present invention. As shown, the system 110 includes a conventional derrick 111 erected on a derrick floor 112 which supports a rotary table 114 that is rotated by a prime mover (not shown) at a desired rotational speed. A drill string 120 that includes a drill pipe section 122 extends downward from rotary table 114 into a directional borehole 126. Borehole 126 may travel in a three-dimensional path. The three-dimensional direction of the bottom 151 of borehole 126 is indicated by a pointing vector 152. A drill bit 150 is attached to the downhole end of drill string 120 and disintegrates the geological formation 123 when drill bit 150 is rotated. The drill string 120 is coupled to a drawworks 130 via a kelly joint 121, swivel 128 and line 129 through a system of pulleys (not shown). During the drilling operations, drawworks 130 is operated to control the weight on bit 150 and the rate of penetration of drill string 120 into borehole 126. The operation of drawworks 130 is well known in the art and is thus not described in detail herein.

During drilling operations a suitable drilling fluid (commonly referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121. Drilling fluid 131 is discharged at the borehole bottom 151 through an opening in drill bit 150. Drilling fluid 131 circulates uphole through the annular space 127 between drill string 120 and borehole 126 and is discharged into mud pit 132 via a return line 135. Preferably, a variety of sensors (not shown) are appropriately deployed on the surface according to known methods in the art to provide information about various drilling-related parameters, such as fluid flow rate, weight on bit, hook load, etc.

A surface control unit 140 may receive signals from downhole sensors and devices via a sensor 143 placed in fluid line 138 and processes such signals according to programmed instructions provided to surface control unit 140. Surface control unit 140 may display desired drilling parameters and other information on a display/monitor 142 which may be used by an operator to control the drilling operations. Surface control unit 140 may contain a computer, memory for storing data, data recorder and other peripherals. Surface control unit 140 may also include models and may process data according to programmed instructions, and respond to user commands entered through a suitable input device, such as a keyboard (not shown).

In one example embodiment of the present invention, a steerable drilling bottom hole assembly (BHA) 159 may comprise a measurement while drilling (MWD) system 158 comprising various sensors to provide information about the formation 123 and downhole drilling parameters. BHA 159 may be coupled between the drill bit 150 and the drill pipe 122.

MWD sensors in BHA 159 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The above-noted devices may transmit data to a downhole transmitter 133, which in turn transmits the data uphole to the surface control unit 140. In one embodiment a mud pulse telemetry technique may be used to communicate data from downhole sensors and devices during drilling operations. A transducer 143 placed in the mud supply line 138 detects the mud pulses responsive to the data transmitted by the downhole transmitter 133. Transducer 143 generates electrical signals in response to the mud pressure variations and transmits such signals to surface control unit 140. Alternatively, other telemetry techniques such as electromagnetic and/or acoustic techniques or any other suitable technique known in the art may be utilized for the purposes of this invention. In one embodiment, hard wired drill pipe may be used to communicate between the surface and downhole devices. In one example, combinations of the techniques described may be used. In one embodiment, a surface transmitter receiver 180 communicates with downhole tools using any of the transmission techniques described, for example a mud pulse telemetry technique. This may enable two-way communication between surface control unit 140 and the downhole tools described below.

BHA 159 may also comprise a drilling motor 190 and stabilizers 160 and 162. In one embodiment, at least one of stabilizers 160 and 162 may be an adjustable stabilizer used to assist in controlling the direction of borehole 126. As discussed previously, radially adjustable stabilizers may be used in the BHA of steerable directional drilling systems to adjust the angle of the BHA with respect to the axis of the borehole. A radially adjustable stabilizer provides a wider range of directional adjustability than is available with a conventional fixed diameter stabilizer. This adjustability may save substantial rig time by allowing the BHA to be adjusted downhole instead of tripping out for changes. However, even a radially adjustable stabilizer provides only a limited range of directional adjustments.

Figure 2:
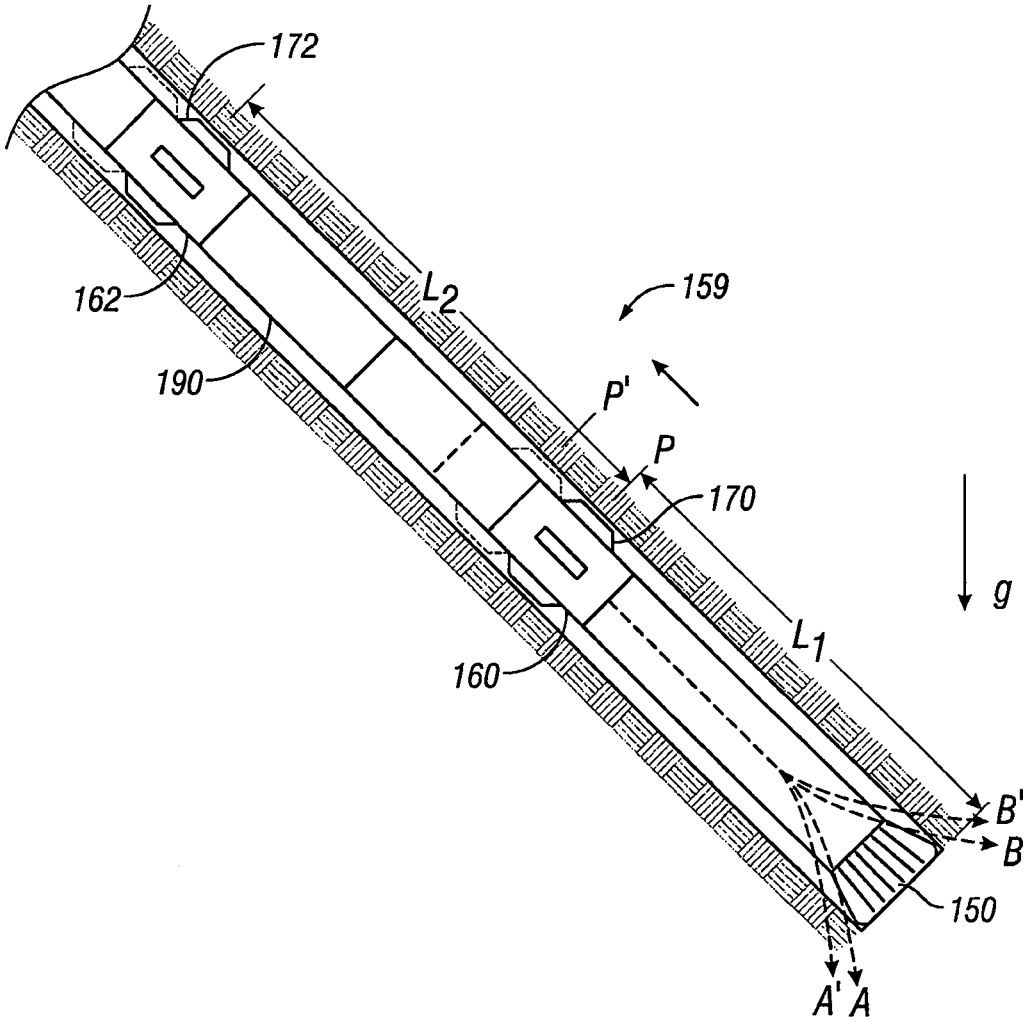
FIG. 2 shows an example of a bottom hole assembly having axially adjustable stabilizers according to various embodiments of the invention.

As shown in the embodiment of FIG. 2, the distance, $L_1$, between bit 150 and first stabilizer 160 is a factor in determining the bend characteristics of BHA 159. Similarly, the distance, $L_2$, between first stabilizer 160 and second stabilizer 162 can be another factor in determining the bend characteristics of BHA 159. Considering first stabilizer 160, the deflection at bit 150 of BHA 159 is a nonlinear function of the distance $L_1$, such that relatively small changes in $L_1$ may significantly alter the bending characteristics of BHA 159. With radially movable stabilizer blades 170, 172, a dropping or building angle, for example A or B, can be induced at bit 150 with the stabilizer at position P. By axially moving stabilizer 160 from P to P', the deflection at bit 150 can be increased from A to A' or B to B'. In one embodiment, a stabilizer having both axial and radial adjustment may substantially extend the range of directional adjustment, thereby saving the time necessary to change out BHA 159 to a different configuration. In other embodiments the stabilizer may be axially movable. The position and adjustment of second stabilizer 162 adds additional flexibility in adjusting BHA 159 to achieve the desired bend of BHA 159 to achieve the desired borehole curvature and direction. In one embodiment the second stabilizer 162 has the same functionality as the first stabilizer 160. While shown in two dimensions, proper adjustment of stabilizer blades 170, 172 may also provide three dimensional turning of BHA 159.

Figure 3A:
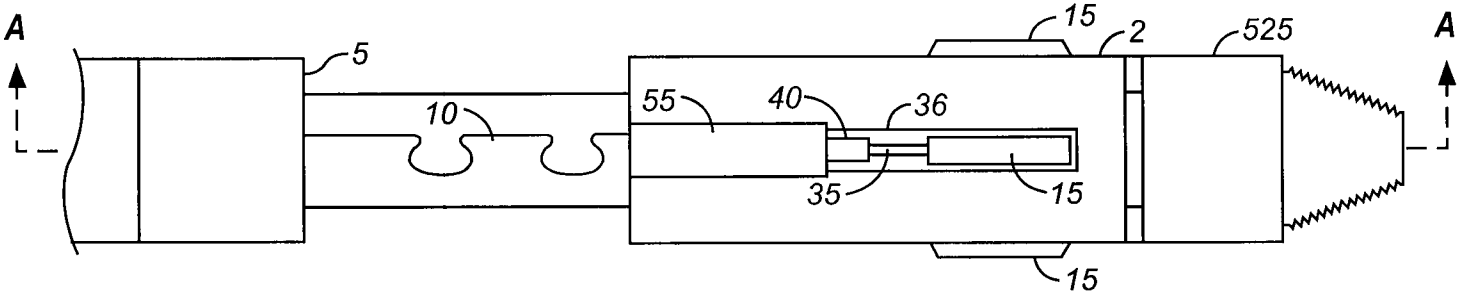
FIG. 3A shows one example embodiment of an adjustable stabilizer having both radial and axial adjustability according to various embodiments of the invention.
Figure 3B:
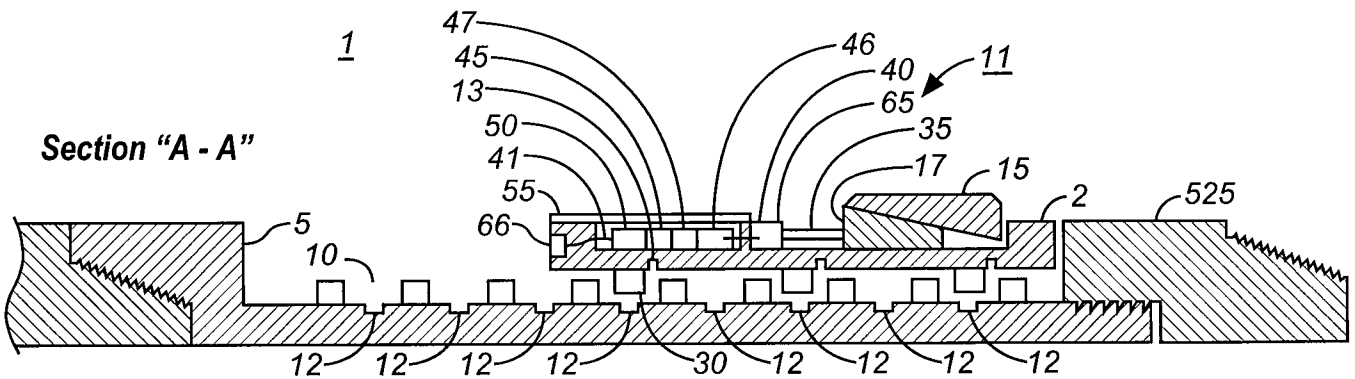
FIG. 3B shows a cross section of the stabilizer of FIG. 3A.

In one example, see FIGS. 3A and 3B, an adjustable stabilizer 1 for use in BHA 159 described above comprises an axially movable sleeve 2 mounted on a mandrel 5. Movable sleeve 2 comprises a blade actuation assembly 11. Blade actuation assembly 11 comprises a radially extendable member, for example blade 15, an actuator 40, and a power source 50. In the example shown in FIG. 3A, radially extendable blade 15 and actuating member 17 are mounted in groove 36 in sleeve 2. While only one actuation assembly 11 is detailed here, multiple actuation assemblies 11 may be incorporated in similar grooves 36 located around the circumference of sleeve 2. Radially extendable blade 15 and actuating member 17 have mated tapered surfaces such that axial motion of actuating member 17 in a first direction extends blade 15 radially outward from stabilizer 1. In one example, blade 15 and actuating member 17 are engageable, for example, with a longitudinal dovetail groove (not shown). This engagement allows movement of actuating member 17 in a second direction opposite the first direction to cause blade 15 to radially retract. Actuating member 17 may be powered axially by an actuator 40 through a rod 35.

Figure 3D:
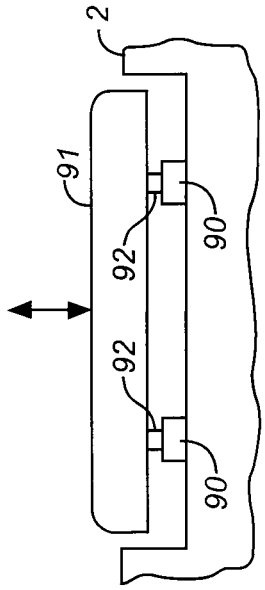
FIG. 3D shows another alternative embodiment of an extendable member according to various embodiments of the invention.
Figure 3C:
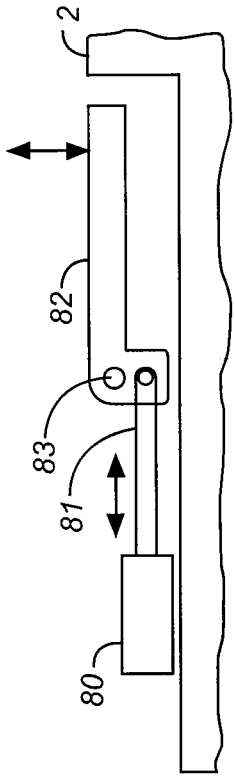
FIG. 3C shows an alternative embodiment of an extendable member according to various embodiments of the invention.

Actuator 40 may be any suitable device capable of axially moving actuating member 17, for example an electromechanical actuator or, alternatively, a hydraulic actuator. Cavity 41 may be formed in sleeve 2 to contain a power source 50 for supplying electrical and/or mechanical power to actuator 40. Cover 55 acts to seal cavity 50 from the surrounding environment. Electrical power may comprise batteries. In one embodiment, a hydraulic supply system 46 may be powered by the batteries to supply hydraulic power to a hydraulically activated actuator 40. Controller 45 controls the movement of actuator 40 and hence movement of radially extendable blade 15. In one example, actuator 40 is a hydraulic cylinder that extends rod 35 to force actuating member 17 into radially extendable blade 15 to radially extend outward toward the wall of borehole 126 (see FIG. 1). When multiple radially extendable blades 15 are incorporated around sleeve 2, each blade 15 may be independently controlled. In addition, each blade 15 may be adjusted to any position between a collapsed position and a fully extended position. One or more sensors 65 may be incorporated in actuator 40 to measure the displacement of and/or the force applied by each radially extendable blade 15. Other radially extendable member alternatives are shown in FIGS. 3C and 3D. FIG. 3C shows actuator 80 extending actuating member 81. Actuating member 81 is engaged with swing arm 82. Swing arm 82 is pivoted about pin 83 such that extension of actuating member 81 forces swing arm 82 outward. Retraction of actuating member 81 causes swing arm 82 to retract inward. In another example, see FIG. 3D, hydraulic cylinders 90 act directly against extendable blade 91 causing blade 91 to extend and retract according to the motion of cylinder rods 92. As used herein, the term radially extendable member encompasses all such examples.

In the example of FIGS. 3A and 3B, axial motion of sleeve 2 may be accomplished by axial motion of the drill string. Slots 10 are formed in mandrel 5 such that pins 30 on an inner diameter of sleeve 2 are engageable in slots 10 at multiple axial positions along mandrel 5. Sensors 12 may be installed along mandrel 5. Likewise detectors 13 may be installed axially spaced apart along sleeve 2 to detect sensors 12 and transmit signals to controller 45 to determine the location of sleeve 2 along mandrel 5. In one example, sensors 12 may be radio frequency identification devices (RFID) that are interrogated by detectors 13 to determine sleeve 2 location. Information regarding sleeve 2 location and blade 15 extension can be used to predict BHA performance and borehole trajectory. In one example, controller 45 may be operatively coupled to transmitter/receiver 66 for sending and receiving signals.

Figure 4:
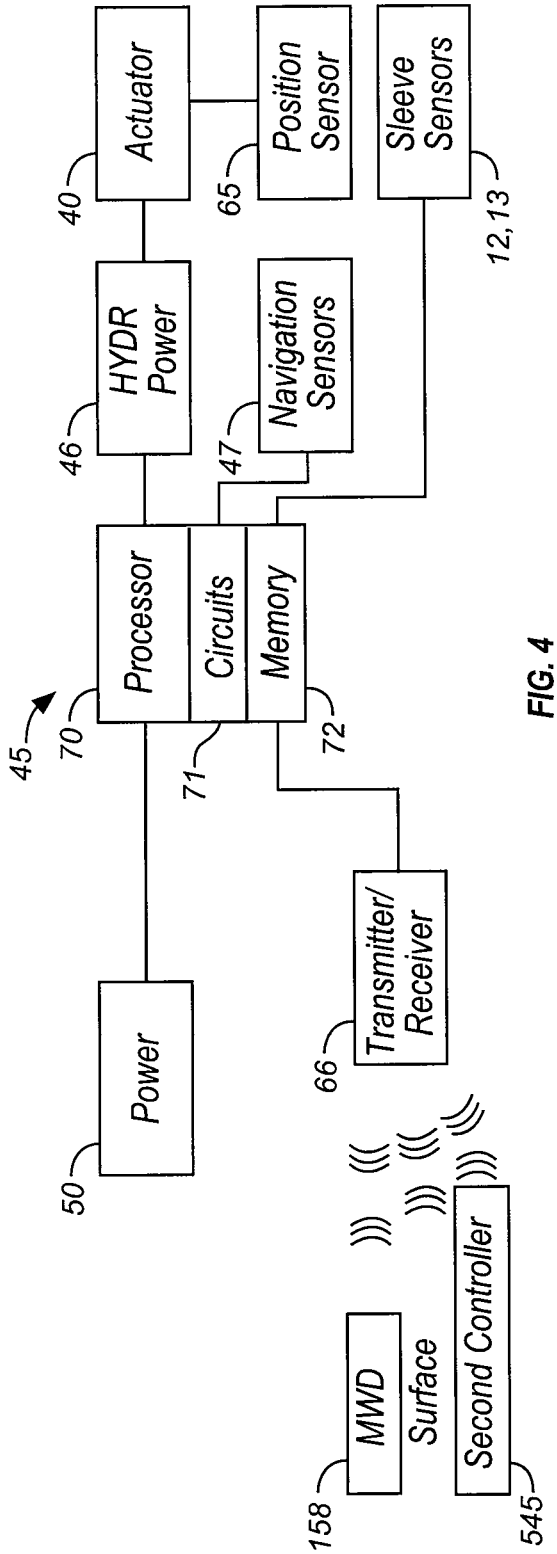
FIG. 4 is a block diagram of an example of an adjustable stabilizer according to various embodiments of the invention.

FIG. 4 shows a functional block diagram of one example of the adjustable stabilizer 1 of FIGS. 3A and 3B. Controller 45 may comprise circuits 71, a processor 70, a memory 72 in data communication with processor 70, sensors, and communication circuits and devices. Control of actuating member 17 and radially extendable blade 15 may be from programmed instruction resident in controller 45 or from telemetered instructions received by controller 45 from an external source, for example, a downhole MWD system in the BHA, or from the surface transmitter 180 (see FIG. 1). Such signals may be transmitted using any suitable technique including, but not limited to, electromagnetic wave telemetry, mud pulse telemetry, wired pipe telemetry, and acoustic telemetry using the drill string as the transmission medium. In one example, controller 45 may be operatively coupled to transmitter/receiver 66 for sending and receiving signals. In one embodiment controller 45 selectively controls the axial movement or the longitudinal movement or both movements of the stabilizer blades to control the pivot point of the BHA to facilitate the adjustment of the downhole angle, and hence the steering ability of the BHA. For example, data signals may be transmitted indicative of the position of extendable blade 15, and instructions may be received to change the position of extendable blade 15. Similarly, data may be transmitted to indicate the position of sleeve 2 along mandrel 5. In one embodiment, navigation devices 47 are incorporated in sleeve 2 to determine the pointing vector of the bottom hole assembly. Such navigation devices may comprise magnetometers, inclinometers, and gyroscopic devices. Data signals indicative of the sensor values and or calculated pointing vector results may be transmitted to a downhole MWD system in the BHA and/or to the surface for analysis. In one embodiment, a desired well trajectory model may be stored in memory 72 of controller 45. Calculated trajectory values from the navigational sensors may be compared to the stored trajectory model and suitable adjustments may be made to the position of extendable blades 15 based on the comparison. In addition, a suggested change in the axial position of sleeve 2 on mandrel 5 may be transmitted to the surface for execution thereof. In one example, transmission of such data may be made to MWD system 158 for retransmission to the surface.

In one operational example of the system described above, navigational sensor data are used downhole to calculate a suggested change in the axial position of sleeve 2 on mandrel 5. The suggested change is transmitted to MWD system 158 where it is retransmitted to the surface. Simultaneously, controller 45 extends blades 15 into contact with wall 156 of borehole 126 thereby holding sleeve 2 fixed against wall 156. With sleeve 2 fixed against wall 156, drill string 122 may be suitably rotated to disengage pins 30 in slots 10. Drill string 22 may then be raised or lowered at the surface and suitably rotated to reengage pins 30 in slots 10 at the new axial location thereby changing the axial location of sleeve 2 relative to mandrel 5. Data signals may be transmitted from the surface to indicate that the change has been made. These signals are received and sent to processor 45. Processor 45 polls sensors 12 and detectors 13 to determine the actual position of sleeve 2 relative to mandrel 5 and determines if the appropriate change has been made. If the appropriate change has not been made, controller 45 transmits, via transmitter/receiver 66, new change signals to the surface and the procedure is repeated until the appropriate change has been made. When the appropriate axial change has been made, controller 45 directs actuator 40 to position blade 15 at the appropriate radial position and drilling commences. This procedure may be repeated whenever the detected wellbore trajectory deviates from the stored model by a predetermined value.

Figure 5A:
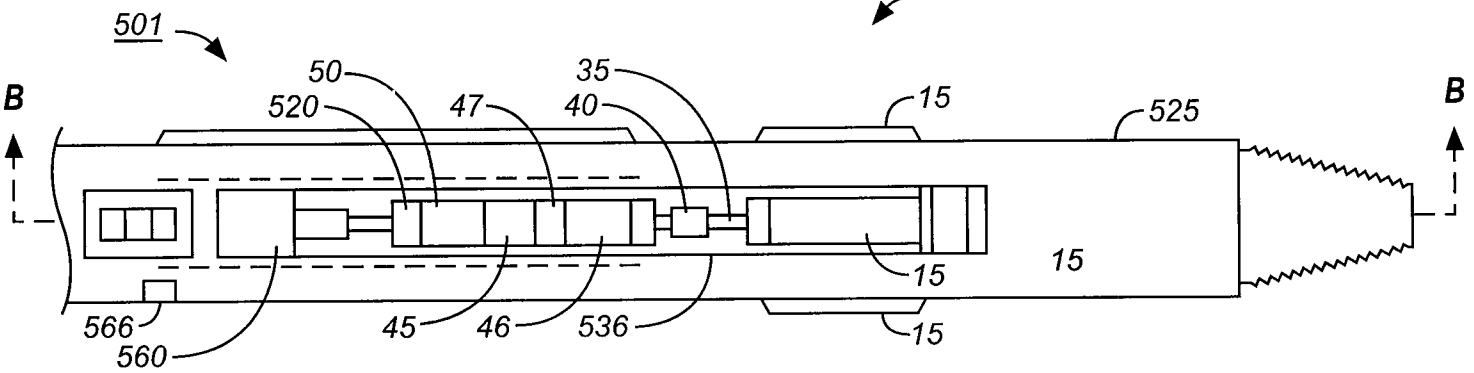
FIG. 5A shows another example embodiment of an adjustable stabilizer having both radial and axial adjustability according to various embodiments of the invention.
Figure 5B:
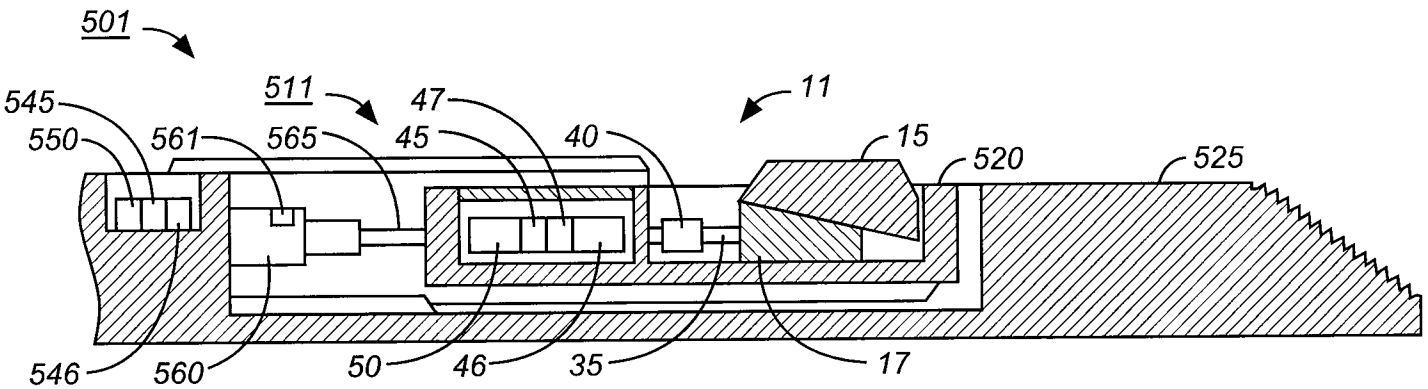
FIG. 5B is a cross section of the stabilizer of FIG. 5A.

In another example, see FIGS. 5A and 5B, an adjustable stabilizer 501 having a radially and axially selectively adjustable blade assembly 511. Radially and axially selectively adjustable blade assembly 511 comprises a blade actuation assembly 11, as described with reference to FIGS. 3A and 3B, mounted on a carrier 520 that slides axially in groove 536 formed in stabilizer sub 525. Radially and axially adjustable blade assembly 511 further comprises a second power source 550, a second controller 545, a power system 546 and a second actuator 560 located in sub 525. In one example power source 550 comprises batteries. In one example, power system 546 is a hydraulic power system driven by second power source 550, providing hydraulic power to second hydraulic actuator 560. Second actuator 560 extends rod 565 to axially position carrier 520 in groove 536. Position sensor 561 may measure the movement of rod rod 565 to determine the axial position of carrier 520. The combined actuation of actuator 40 and second actuator 560 enables radial actuation and axial movement of extendable blade 15. While only one such radially and axially movable blade is shown in detail, multiple such assemblies may be located around the circumference of sub 525.

Second controller 545 and controlling actuator 560 may be located in sub 525 and be in communication via transmitter/receiver 566 with controller 45 on carrier 520. In addition, second controller 545 may be in communication with an MWD system located in BHA 159 and/or a receiver at the surface.

Figure 6:
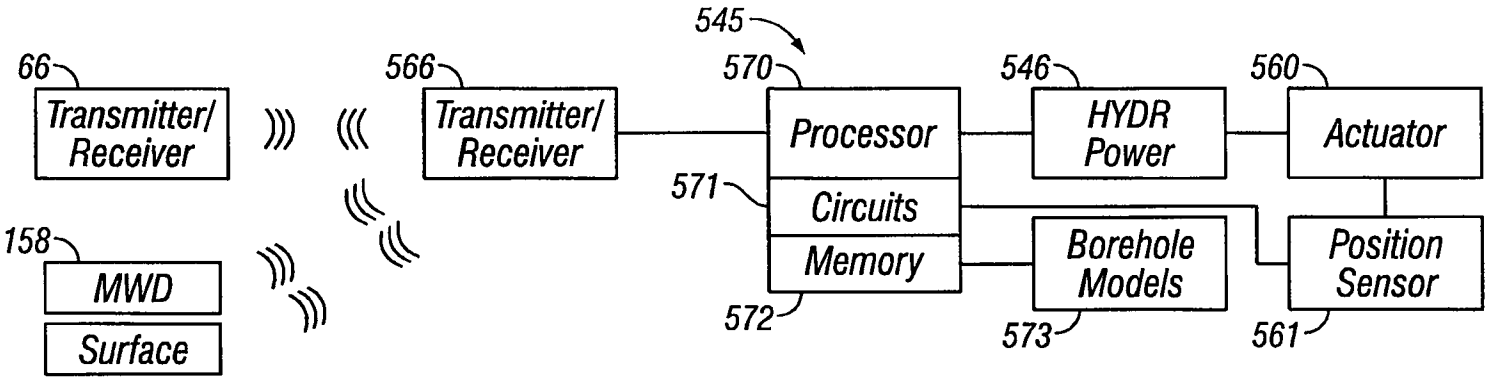
FIG. 6 is a block diagram of a portion of one embodiment of an adjustable stabilizer according to various embodiments of the invention.

Communication may be by wireless and/or hard wired techniques known in the art. In one embodiment, electrical power is supplied to second controller 545 through hard wired pipe in drill string 122. In one embodiment, see FIG. 6, second controller 545 has a processor 570, circuits 571, and a memory 572, similar to that of controller 45.

Second controller 545 may act as a master controller for controlling both radial extension of extendable blade 15 and the axial position of carrier 520. For example, second controller 545 may receive raw and/or processed navigational data from navigation sensors 47. This data may be used to determine the three-dimensional pointing vector of a BHA including adjustable stabilizer 501. Model 573 of desired borehole 126 trajectory may be stored in memory in controller 545. In one embodiment, controller 545 may compute the borehole 126 trajectory based on the navigational sensor measurements and compare the calculated trajectory with a desired trajectory stored in memory. Controller 545 may then adjust the radial position of blade 15 and/or the axial position of blade 15 necessary to steer borehole 126 back to the desired trajectory. Alternatively, controller 545 may calculate a new trajectory to a desired target and adjust the radial and/or axial position of blade 15 to follow the new trajectory.

Figure 7:
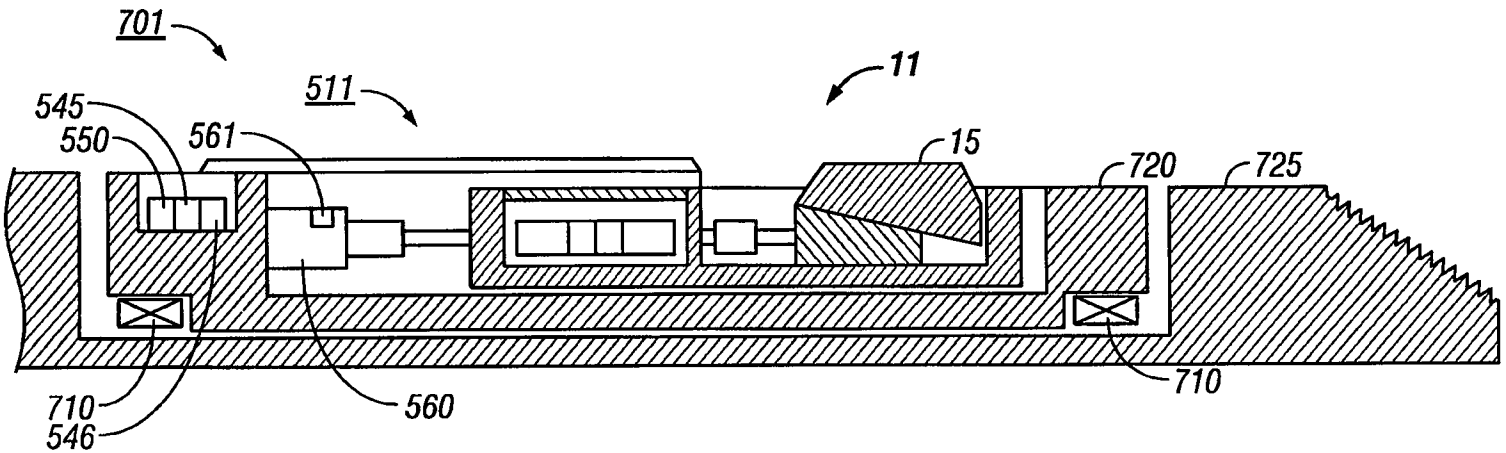
FIG. 7 a shows an example of a stabilizer having a rotatable sleeve according to various embodiments of the invention.

In one embodiment, see FIG. 7, adjustable stabilizer 701 comprises at least one radially and axially adjustable blade assembly 511 disposed on a sleeve 720 that is coupled to sub body 725 through bearings 710. Sleeve 720 and sub body 725 are rotatable relative to each other. Radially and axially adjustable blade assembly 511 operates as described with regard to FIGS. 5A-6. In operation, one or more blades 15 may be extended to contact wall 156 of borehole 126 (see FIG. 1) providing the appropriate bend to the bottom hole assembly to steer the borehole in the desired direction. In this embodiment, the bottom hole assembly, including sub body 725 may be rotated to rotate bit 150.

This Detailed Description is illustrative, and not restrictive. Many other embodiments will be apparent to those of ordinary skill in the art upon reviewing this disclosure. The scope of embodiments should therefore be determined with reference to the appended claims, along with the full scope of equivalents to which such claims are entitled.

The Abstract of the Disclosure is provided to comply with 37 C.F.R. §1.72(b) and will allow the reader to quickly ascertain the nature of the technical disclosure. It is submitted with the understanding that it will not be used to interpret or limit the scope or meaning of the claims.

In this Detailed Description of various embodiments, a number of features are grouped together in a single embodiment for the purpose of streamlining the disclosure. This method of disclosure is not to be interpreted as an implication that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a tubular member coupled to a drill bit; and an adjustable stabilizing member coupled to the tubular member, wherein the adjustable stabilizing member is axially movable, from a first axial location along the tubular member to a second axial location along the tubular member, and wherein the adjustable stabilizing member is radially extendable at the first and the second axial locations, to define a movable pivot point location along the tubular member.

2. The apparatus of claim 1, further comprising:

a controller to selectively adjust at least one of the radial extension and an axial position of the adjustable stabilizing member.

3. The apparatus of claim 2, further comprising:

an actuator communicatively coupled to the controller, the actuator to mode the adjustable stabilizing member in at least one of a radial direction or an axial direction relative to the bottom hole assembly.

4. The apparatus of claim 3, wherein the actuator comprises a first actuator to extend the adjustable stabilizing member in the radial direction, and a second actuator to position the adjustable stabilizing member in the axial direction.

5. The apparatus of claim 2, wherein the controller is operable to adjust the radial extension and the axial position of the adjustable stabilizing member based at least in part on a comparison of a determined borehole trajectory and a model of a desired borehole trajectory stored in a memory of the controller.

6. The apparatus of claim 1, further comprising:

a sleeve surrounding at least a part of the tubular member, wherein the adjustable stabilizing member is mechanically coupled to the sleeve.

7. The apparatus of claim 6, wherein a longitudinal groove is formed in the sleeve, with an axially positionable carrier disposed in the groove.

8. The apparatus of claim 7, further comprising:

a radially extendable member disposed on the carrier.

9. The apparatus of claim 6, further comprising:

at least one bearing disposed between the sleeve and the tubular member, wherein the sleeve is rotatable relative to the tubular member.

10. The apparatus of claim 1, wherein the adjustable stabilizing member comprises:

a plurality of blades that can be coupled to a borehole.

11. The apparatus of claim 1, further comprising:

a first sensor for detecting a radial position of the adjustable stabilizing member; and a second sensor for detecting an axial position of the adjustable stabilizing member.

12. A system, comprising:

drill pipe;

a drill bit; and an apparatus coupled between the drill pipe and the drill bit, the apparatus comprising a tubular member coupled to a bottom hole assembly and an adjustable stabilizing member coupled to the tubular member, wherein the adjustable stabilizing member is axially movable from a first axial location along the tubular member to a second axial location along the tubular member, and wherein the adjustable stabilizing member is radially extendable at the first and the second axial locations, to define a movable pivot point location along the tubular member.

13. The system of claim 12, further comprising:

a surface control unit to receive signals from at least one downhole navigation sensor attached to the apparatus, the surface control unit operable to adjust a borehole trajectory by controlling radial extension and axial movement of the adjustable stabilizing member.

14. The system of claim 12, further comprising:

a transmitter/receiver to communicate with the surface control unit.

15. The system of claim 12, wherein the apparatus further comprises:

a stabilizer sub with a sleeve surrounding at least a portion of the stabilizer sub, wherein a longitudinal groove is formed in the sleeve, with an axially positionable carrier disposed in the groove and a radially extendable member disposed on the carrier.

16. A method, comprising:

coupling a tubular member to a bottom hole assembly and a drill bit;

disposing at least one adjustable stabilizing member on the tubular member; and controlling at least one of a radial extension of the adjustable stabilizing member and an axial position of the adjustable stabilizing member relative to the bottom hole assembly to adjust a trajectory of a borehole, wherein the adjustable stabilizing member is axially movable from a first axial location along the tubular member to a second axial location along the tubular member, and wherein the adjustable stabilizing member is radially extendable at the first and the second axial locations, to define a movable pivot point location along the tubular member.

17. The method of claim 16, further comprising:

determining the trajectory of the borehole.

18. The method of claim 17, wherein the controlling comprises:

comparing the trajectory of the borehole to a model of a desired borehole trajectory; and positioning the at least one adjustable stabilizing member based on the comparing.

19. The method of claim 16, wherein the controlling comprises:

adjusting the radial extension and the axial position of the movable member based at least in part on instructions received from a surface location.

20. The method of claim 16, further comprising:

moving a drill string at a surface location to adjust the axial position of the adjustable stabilizing member, the drill string mechanically coupled to the tubular member.

* * * * *

UNITED STATES PATENT AND TRADEMARK OFFICE

CERTIFICATE OF CORRECTION

PATENT NO. : 8,434,567 B2
APPLICATION NO. : 12/896386
DATED : May 7, 2013
INVENTOR(S) : Menezes et al.

It is certified that error appears in the above-identified patent and that said Letters Patent is hereby corrected as shown below:

In the Claims

In column 7, line 12, in claim 1, delete “movable,” and insert --movable--, therefor Signed and Sealed this
Seventeenth Day of September, 2013

Teresa Stanek Rea
*Deputy Director of the United States Patent and Trademark Office*